US007002105B2

(12) United States Patent
Suzumi

(10) Patent No.: US 7,002,105 B2
(45) Date of Patent: Feb. 21, 2006

(54) IMAGE HEATING APPARATUS

(75) Inventor: Masahiko Suzumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/873,726

(22) Filed: Jun. 21, 2004

(65) Prior Publication Data

US 2005/0006370 A1 Jan. 13, 2005

(30) Foreign Application Priority Data

Jul. 7, 2003 (JP) ..... 2003-192852

(51) Int. Cl.
*H05B 1/00* (2006.01)

(52) U.S. Cl. ..... 219/216; 399/328

(58) Field of Classification Search ..... 219/216, 219/530, 540, 543, 243–244; 338/306–309; 399/69, 328, 32, 43
See application file for complete search history.

(56) References Cited

U.S. PATENT DOCUMENTS

| | | | | |
|---|---|---|---|---|
| 5,148,226 | A | 9/1992 | Setoriyama | |
| 5,210,579 | A | 5/1993 | Setoriyama | |
| 5,525,775 | A | 6/1996 | Setoriyama | |
| 6,198,901 | B1 * | 3/2001 | Watanabe | 399/328 |
| 6,516,164 | B1 | 2/2003 | Kawazu | |
| 2003/0038125 | A1 * | 2/2003 | Kataoka et al. | 219/216 |

FOREIGN PATENT DOCUMENTS

| | | |
|---|---|---|
| JP | 02-157878 | 6/1990 |
| JP | 04-044075 | 2/1992 |
| JP | 4-44078 A | 2/1992 |
| JP | 4-44083 A | 2/1992 |
| JP | 04-204980 | 7/1992 |
| JP | 4-204981 A | 7/1992 |
| JP | 4-204982 A | 7/1992 |
| JP | 63-313182 | 12/1998 |

* cited by examiner

*Primary Examiner*—Tu Ba Hoang
*Assistant Examiner*—Vinod Patel
(74) *Attorney, Agent, or Firm*—Canon USA, Inc. IP Dept.

(57) ABSTRACT

The present invention relates to an image heating apparatus, such as a heating fixing apparatus for fixing a toner image formed on plane paper. By making the width of a heat collecting plate of a thermoprotector for suppressing an excessive temperature rise of a heater provided in the apparatus, a failure in an image is suppressed irrespective of variations in the mounting position of the thermoprotector.

5 Claims, 7 Drawing Sheets

DEVIATION TO UPSTREAM SIDE

DESIGNED POSITION

DEVIATION TO DOWNSTREAM SIDE

DEVIATION TO UPSTREAM SIDE

DESIGNED POSITION

DEVIATION TO DOWNSTREAM SIDE

IMAGE HEATING APPARATUS

BACKGROUND OF THE INVENTION

1. Field of the Invention

The present invention relates to an image heating apparatus, such as a heating fixing apparatus, or the like, that is mounted in an image forming apparatus (such as a copier, a printer, or the like) adopting an electrophotographic method or an electrostatic recording method.

2. Description of the Related Art

Conventionally, a heating apparatus adopting a heat roller method or a film heating method has been widely used as an image heating apparatus, such as a heating fixing apparatus.

In contrast to a heating apparatus adopting a heat roller method, a heating apparatus adopting a film heating method is an on-demand and energy-saving apparatus in which electric power is not supplied during a standby state and power consumption can be minimized.

Such a heating apparatus includes a fixedly supported heater, a flexible member moving or rotating while contacting the heater, and a pressing member that forms a nip portion with the heater via the flexible member, and heats a material to be heated by heat from the heater via the flexible member while grasping and conveying the material between the flexible member and the pressing member at the nip portion.

More specifically, a ceramic heater is generally used as the heater. The ceramic heater has a basic configuration that includes an insulating, heat-conductive and low-heat-capacity ceramic substrate (heater substrate) made of alumina, or the like, and an electrically-heat-generating resistive layer made of silver-palladium (Ag/Pd), $Ta_2N$, or the like formed on the substrate in the longitudinal direction of the substrate. The electrically-heat-generating resistive layer is heated by causing electric current to pass therein, so that the temperature of the entire heater including the substrate is rapidly raised. The temperature rise of the heater is detected by temperature detection means, such as a thermistor, or the like, and is fed back to a current control unit. The current control unit controls current supply to the electrically-heat-generating resistive layer so that the temperature of the heater detected by the temperature detection means is maintained at a predetermined substantially constant temperature (fixing temperature).

In order to efficiently transmit heat from the heater to a recording material, serving as a material to be heated, a thin heat-resistant and flexible resin film (hereinafter termed a "fixing film") in the form of a cylindrical film or an endless film is generally used as the flexible member.

A heat-resistant and elastic pressing roller is generally used as the pressing member, and forms a nip portion (hereinafter termed a "fixing nip portion" or a "heating nip portion") having a predetermined width (in the sheet feeding direction) by being in pressure contact with the heater via the fixing film, serving as the flexible member, against the elasticity of the pressing roller.

The fixing film, serving as the flexible member, is movably or rotatably driven by the rotation driving of the pressing roller, serving as the pressing member, or by driving member other than the pressing roller, to be conveyed and moved in tight sliding contact with the surface of the heater at the fixing nip portion.

In a state in which current is supplied to the electrically-heat-generating resistive layer of the heater, the moving driving or the rotation driving of the fixing film is started, the heater is subjected to temperature control after the temperature of the heater is raised to a predetermined fixing temperature, and the conveying/moving speed of the fixing film is stabilized after being increased to a predetermined speed, a recording material, serving as a material to be heated, having an unfixed image formed thereon is guided between the fixing film and the pressing roller at the fixing nip portion. The recording material is heated by heat from the heater via the fixing film while being grasped and conveyed between the fixing film and the pressing roller at the fixing nip portion, so that the unfixed image is heated and fixed on the surface of the recording material. A portion of the recording material passing through the fixing nip portion is conveying by being separated from the surface of the fixing film.

In the above-described heating apparatus, as a safety countermeasure during thermal runaway of the heater, i.e., when the heater becomes in an excessive high temperature state as a result of continuous current supply to the electrically-heat-generating resistive layer of the heater because current supply to the electrically-heat-generating resistive layer becomes in an uncontrolled state due to a some failure, a safety element (hereinafter termed a "thermoprotector"), such as a temperature fuse, a thermoswitch, or the like, for forcedly shutting down current supply to the electrically-heat-generating resistive film by detecting an excessive high temperature higher than a temperature allowed for the heater is disposed so as to contact a surface of the heater opposite to the sliding surface with the fixing film.

The thermoprotector is disposed so that a heat collecting plate thereof contacts a surface of the heater opposite to a sliding surface with the fixing film. In this case, in order to prevent uneven heat collection of the heat collecting plate, a heat-conductive grease is coated on a contact surface between the heat collecting plate of the thermoprotector and the heater.

Since the thermoprotector has a relatively large heat capacity, heat quantity generated in the electrically-heat-generating resistive layer is transferred to the thermoprotector at the contact position of the heater with the thermoprotector. As a result, sufficient heat quantity is not supplied to the recording material as compared to positions of the heater other than the contact position of the heater with the thermoprotetor, sometimes resulting in a failure in fixing at the contact position. In order to prevent such a phenomenon, heat quantity at the contact position is secured by increasing the resistance value of a portion of the electrically-heat-generating resistive film corresponding to the contact position by more or less decreasing the width of that portion. Thus, the amount of heat supply to the recording material is made uniform (or to have a designed temperature distribution) over the longitudinal direction of the heater (a direction orthogonal to the sheet feeding direction), to realize excellent heating fixing not having unevenness in fixing.

It has become clear that if the contact position of the safety element with the heater deviates from a designed position in a direction of ends of the heater (the sheet feeding direction), a high-temperature offset of a toner image and a failure in an image, such as unevenness in gloss, or the like, occur.

Since the safety element is mounted on the heater using many components, such as a heater holder, a safety-element holder, and the like, accuracy in mounting of the safety element results from addition of dimensional tolerances of the respective components. Accordingly, the contact position of the safety element with the heater tends to vary with respect to the designed position. It has become clear that the temperature distribution in a contact portion of the heater with the safety element differs from the temperature distribution in other portions of the heater in the longitudinal direction, and a high-temperature offset, a failure in fixing, and unevenness in gloss occur at the contact portion of the heater with the safety element.

SUMMARY OF THE INVENTION

The present invention has been made in consideration of the above-described problems.

It is an object of the present invention to provide an image heating apparatus that can suppress a failure in heating of an image.

It is another object of the present invention to provide an image heating apparatus that can suppress a failure in heating of an image even if a contact position of a thermoprotector with a heater more or less deviates in a recording-material moving direction.

According to one aspect of the present invention, an image heating apparatus includes a heater for heating an image formed on a recording material, and a thermoprotector for suppressing an excessive temperature rise of the heater. The thermoprotector includes a heat collecting portion contacting the heater. A width of the heat collecting portion in a moving direction of the recording material is larger than a width of the heater in the moving direction of the recording material.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS (First Embodiment)

(1) Example of an Image Forming Apparatus

Figure 1:
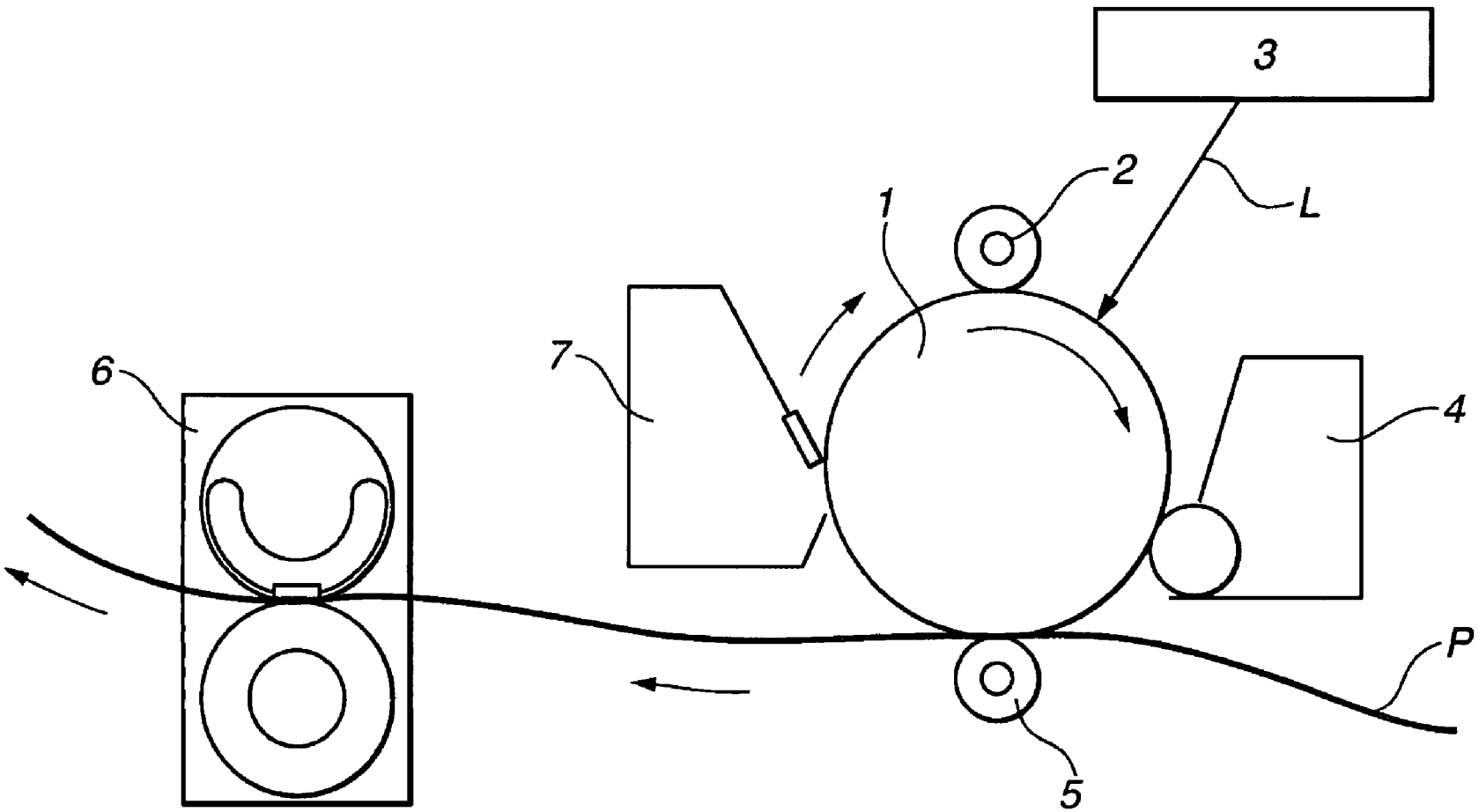
FIG. 1 is a schematic diagram illustrating the configuration of an image forming apparatus according to a first embodiment of the present invention.

FIG. 1 is a schematic diagram illustrating the configuration of an image forming apparatus according to a first embodiment of the present invention. This image forming apparatus is a laser printer using a transfer-type electrophotographic process having a process speed of 127 mm/s and a throughput of 22 ppm (LTR).

A photosensitive drum 1 serves as an image bearing member, and is obtained by forming a layer of a photosensitive material, such as an OPC (organic photoconductor), amorphous Se, amorphous Si, or the like, on a cylindrical substrate made of aluminum, nickel, or the like.

The photosensitive drum 1 is rotatably driven in the direction of an arrow at a predetermined circumferential speed. First, the surface of the photosensitive drum 1 is uniformly charged to a predetermined polarity and a predetermined potential by a charging roller 2, serving as a charging apparatus.

Then, the photosensitive drum 1 is subjected to image exposure L by a laser scanner 3, serving as an image exposure apparatus. The laser scanner 3 performs scanning exposure on the surface of the rotating photosensitive drum 1 by outputting a laser beam subjected to on/off control in accordance with image information. An electrostatic latent image corresponding to the image information is thereby formed on the photosensitive drum 1.

This electrostatic latent image is developed and visualized by a developing apparatus 4. A jumping developing method, a two-component developing method, a FEED developing method, or the like is used as the developing method. Combination of image exposure and reversal development is often used.

A recording material (transfer material) P is individually fed from a sheet feeding mechanism (not shown), and is conveyed to a transfer nip portion that is a pressure contact portion between the photosensitive drum 1 and a transfer roller 5, serving as a transfer apparatus, at a predetermined timing. The recording material P is grasped and conveyed through the transfer nip portion with a constant pressing force. At this transfer nip portion, the toner image on the photosensitive drum 1 is transferred onto the recording material P by means of a transfer bias voltage provided from a power supply (not shown).

The recording material P passing through the transfer nip portion is separated from the surface of the photosensitive drum 1, and is conveyed to a fixing apparatus 6 while holding the toner image. The toner image is fixed on the recording material P by being heated and pressed at a fixing nip portion of the fixing apparatus 6 to provide a permanent image, and the recording material P having the fixed toner image thereon is discharged outside of the image forming apparatus.

After separating the recording material P, toner particles remaining on the rotating photosensitive drum 1 after image transfer are removed and cleaned from the surface of the photosensitive drum 1 by a cleaning apparatus 7, and the photosensitive drum 1 is repeatedly used for image formation.

(2) Fixing Apparatus (Fixing Unit) 6 a) Schematic Configuration of the Entire Apparatus

Figure 2:
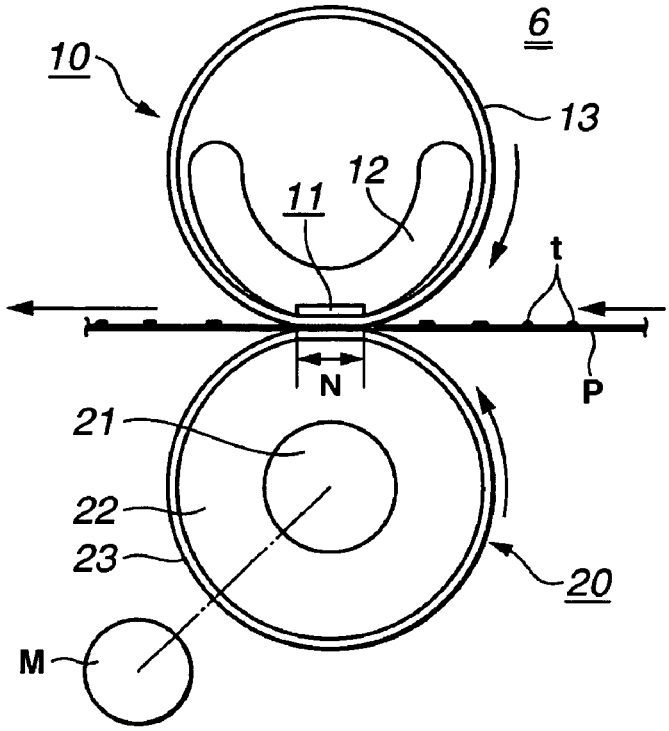
FIG. 2 is a schematic cross-sectional view of a fixing apparatus.
Figure 3:
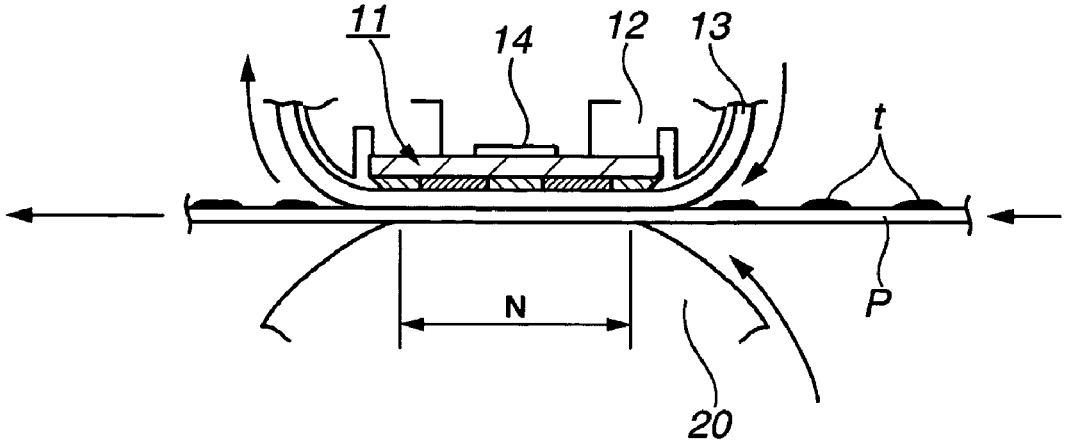
FIG. 3 is an enlarged schematic diagram of a fixing nip portion.

FIG. 2 is an enlarged transverse sectional view illustrating the fixing apparatus 6. FIG. 3 is an enlarged schematic diagram illustrating the fixing nip portion. The fixing apparatus of the first embodiment is a heating apparatus adopting a film heating method and a pressing-rotating-member driving method (a tensionless type) using a cylindrical fixing film (having the shape of an endless belt) disclosed, for example, in Japanese Patent Application Laid-Open (Kokai) Nos. 4-44075–44083 (1992) and 4-204980–204984 (1992).

Reference numeral 10 represents a fixing member (a fixing unit, or a heating unit), and reference numeral 20 represents a pressing roller, serving as a pressing member. By pressure contact between the fixing member 10 and the pressing member 20, a fixing nip portion N having a predetermined width is formed in the sheet feeding direction.

The fixing member 10 is longitudinal in a direction perpendicular to the plane of FIG. 2 (a direction orthogonal to the sheet feeding direction), and includes a heat-resistant, heat-insulating and rigid stay holder (a supporting member, or a heater holder) 12 whose cross section has the shape of a substantially semicircular gutter, and a heater (a heating member) 11 generating heat by supplying current that is fixed at the lower surface of the stay holder 12 by being fit in a concave groove portion provided along the longitudinal direction of the stay holder 12, a cylindrical heat-resistant thin fixing film (a flexible sleeve) 13, serving as a flexible member, loosely fitted on the outer circumference of the stay holder 12 mounting the heater 11, and the like.

The pressing roller 20, serving as the pressing member, is a rotating member obtained by concentrically and integrally forming an elastic layer 22 made of a heat-resistant rubber, such as silicone rubber, fluororubber, or the like, or foamed silicone rubber on a core 21. A heat-resistant mold releasing layer 23 made of a fluororesin, such as PFA, PTFE, FEP or the like, may also be formed on the elastic layer 22.

The pressing roller 20 is disposed by rotatably supporting both end portions of the core 21 on a bearing member between side plates provided at the front side and the rear side of an apparatus chassis (not shown).

The fixing member 10 is disposed above the pressing roller 20 so as to be parallel to the pressing roller 20 in a state in which the heater 11 is placed downward. By urging both end portions of the stay holder 12 in a direction of the axis of the pressing roller 20 by pressing means (not shown), such as a spring, or the like, the lower surface of the heater 11 is brought in pressure contact with the elastic layer 22 of the pressing roller 20 via the fixing film 13 against the elasticity of the elastic layer 22, to form the fixing nip portion N having the predetermined width necessary for fixing by heating. A configuration may also be adopted in which the fixing nip portion N having the predetermined width is formed by urging and raising the pressing roller 20 toward the lower surface of the fixing member 10 using pressing means.

The pressing roller 20 is rotatably driven by driving means M in a counterclockwise direction indicated by an arrow at a predetermined circumferential speed. A rotational force is applied to the cylindrical fixing film 13 by a pressing frictional force at the fixing nip portion N between the outer surface of the pressing roller 20 and the fixing film 13 caused by rotatable driving of the pressing roller 20, so that fixing film 13 is rotatably driven in a clockwise direction indicated by an arrow around the outer circumference of the stay holder 12 in a state in which the inner surface of the fixing film 13 is in tight sliding contact with the lower surface of the heater 11.

In a state in which the pressing roller 20 is rotatably driven, the cylindrical fixing film 13 is thereby rotatably driven, current is supplied to the heater 11, and the temperature of the heater 11 is raised to a predetermined temperature and is subjected to temperature control, the recording material P, serving as the material to be heated, bearing the unfixed toner image t is guided between the fixing film 13 and the pressing roller 20 at the fixing nip portion N, and the recording material P is grasped and conveyed through the fixing nip portion N together with the fixing film 13 in a state in which a surface of the recording material P bearing the toner image is in tight contact with the outer surface of the fixing film 13. In this grasped and conveyed process, heat from the heater 11 is transferred to the recording material P via the fixing film 13, to fuse and fix the unfixed toner image t on the recording material P by heat and pressure. The recording material P passing through the fixing nip portion N is separated from the fixing film 13 with having a curvature.

In this heating apparatus adopting the film heating method that uses the fixing thin film 13, the fixing nip portion N having the predetermined width is formed by the ceramic heater 11, serving as the heating member, and the pressing roller 20 having the elastic layer 22, via the fixing film 13. By heating only the fixing nip portion N, quick-start fixing by heating is realized.

b) Stay Holder 12

The stay holder 12 is a heat-resistant, heat-insulating and rigid member for preventing heat radiation in a direction opposite to the fixing nip portion N, and is made of a heat-resistant plastic material, such as a liquid-crystal polymer, phenol resin, PPS, PEEK, or the like. The cylindrical fixing film 13 is loosely fit on the outer surface of the stay holder 12, so that the stay holder 12 also operates as a conveying guide for the fixing film 13.

c) Fixing Film 13

The fixing film 13, serving as the flexible member, is a film having a small heat capacity that is made of heat-resistant thermoplastic polyimide, polyamide-imide, PEEK, PES, PPS, PFA, PTFE, FEP, or the like having a thickness equal to or less than 100 $\mu$m in order to allow quick-start heating. In order to operate as a film having a sufficient strength and durability for constituting a long-life heating fixing apparatus, a thickness of at least 20 $\mu$m is necessary. Accordingly, a thickness equal to or more than 20 $\mu$m and equal to or less than 100 $\mu$m is optimum for the fixing film 13. In order to prevent an offset and secure separability of the recording material, a heat-resistant resin having an excellent mold releasing property, such as PFA, PTFE, FEP, or the like, or a mixture of such resins is coated on the surface of the fixing film 13.

More specifically, in order to efficiently transfer heat from the heater 11 to the recording material P, serving as the material to be heated, at the fixing nip portion N, the fixing film 13 has a considerably small thickness of 20–70 $\mu$m. The fixing film 13 has a three-layer configuration including a film base layer, a primer layer and a mold releasing layer. The film base layer faces the heater 11, the mold releasing layer faces the pressing roller 20. The film base layer is made of polyimide, polyamide-imide, PEEK, or the like having a higher insulating property than a glass protective layer of the heater 11, and has a heat resisting property and high elasticity. The film base layer provides a mechanical strength, such as a tear strength, and the like, of the entire fixing film 13. The primer layer is a thin layer having a thickness of about 2–6 $\mu$m. The mold releasing layer is a layer for preventing a toner offset for the fixing film 13, and is formed by coating a fluororesin, such as PFA, PTFE, FEP, or the like, to a thickness of about 10 $\mu$m.

Since the fixing film 13 rotates in sliding contact with the heater 11 and the stay holder 12 within the fixing film 13, it is necessary to minimize frictional resistance between the heater 11 and the stay holder 12, and the fixing film 13. Accordingly, a small amount of lubricant, such as heat-resistant grease, or the like, is provided on a surface of the heater 11 contacting the fixing film 13, and on a surface of the stay holder 12 contacting the fixing film 13. As a result, the fixing film 13 can smoothly rotate.

d) Heater 11

Figure 4:
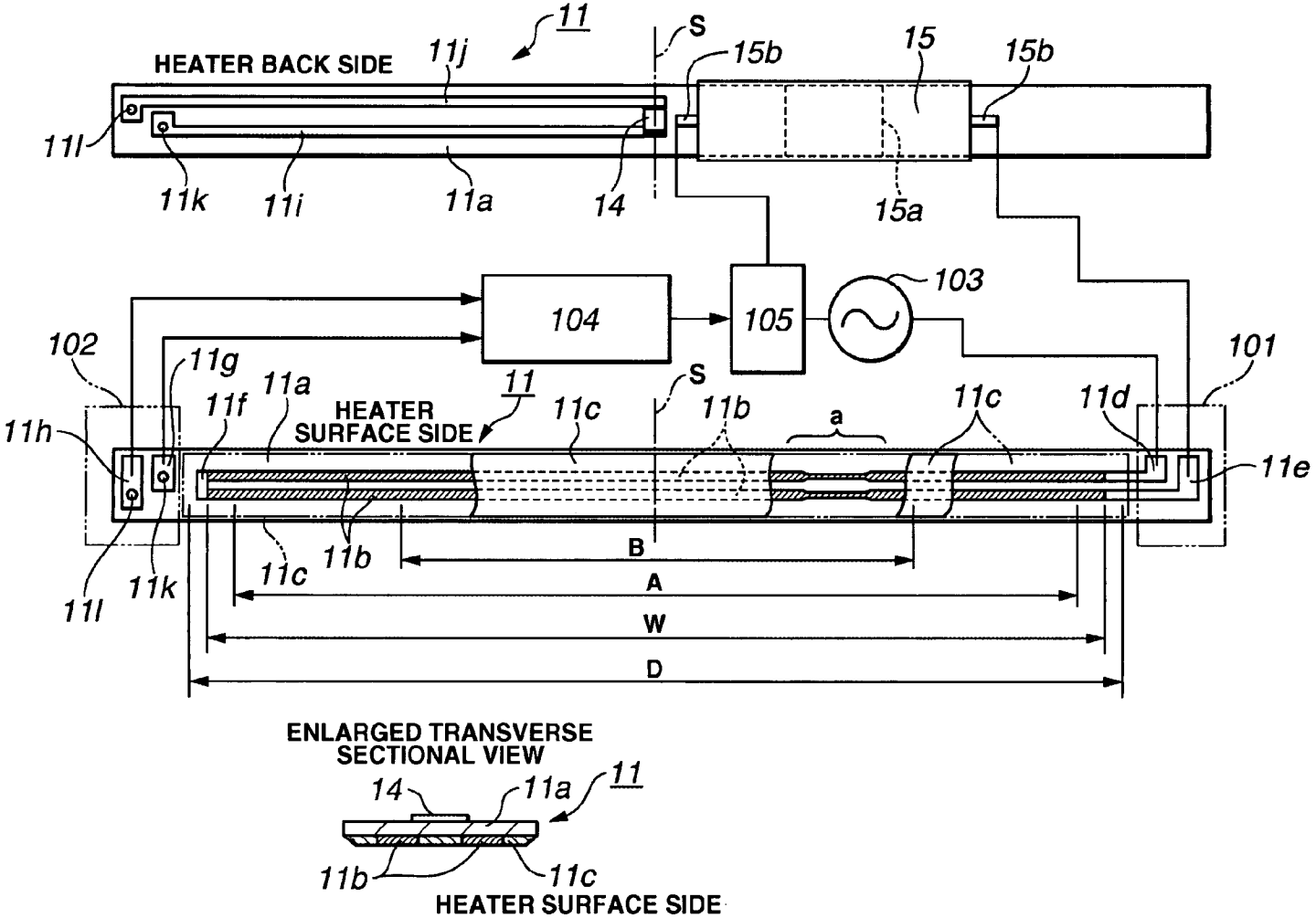
FIG. 4 is a diagram illustrating the configuration of a heater.

FIG. 4 is a diagram illustrating the configuration of the heater 11 of the first embodiment. Basically, the heater 11 is a surface-heating-type ceramic heater having a low heat capacity made by forming an electrically-heat-generating resistive layer 11*b* made of silver-palladium, or the like on an $Al_2O_3$ or AlN substrate 11*a* having a high heat conductivity, and further forming a thin glass protective layer 11*c*.

More specifically, the heater 11 includes:

(1) the $Al_2O_3$ or AlN substrate 11*a* having, for example, a width of 6 mm×a length of 270 mm×a thickness of 1 mm in which a direction orthogonal to the sheet feeding direction at the fixing nip portion N is a longitudinal direction;

(2) the two parallel electrically-heat-generating resistive layers 11*b* obtained by coating and firing a pattern of a resistive material, such as Ag/Pd (silver-palladium) or the like, to a thickness of about 10 μm and a width of 1–3 mm according to screen printing, or the like along the longitudinal direction of the heater substrate 11*a* on a surface (a surface contacting the film 13) of the heater substrate 11*a;*

(3) first and second current supplying electrode patterns 11*d* and 11*e*, respectively, formed by being electrically connected to the electrically-heat-generating resistive layers 11*b* on the surface of the heater substrate 11*a* at one end portions of the two parallel electrically-heat-generating resistive layers 11*b;*

(4) a conductive pattern 11*f* formed on the surface of the heater substrate 11*a* in order to electrically connect in series another end portions of the two parallel electrically-heat-generating resistive layers 11*b;*

(5) first and second electrode patterns 11*g* and 11*h* for output to a temperature control unit, formed on the surface of the heater substrate 11*a* at the conductive pattern 11*f* side;

(6) the thin glass protective layer 11*c* having a thickness of about 10 μm provided so as to cover the electrically heat generating resistive layer 11*b* and the conductive pattern 11*f* on the heater substrate 11*a;*

(7) a temperature detector 14, such as a thermistor, or the like, provided so as to contact a central portion of the heater substrate 11*a* in the longitudinal direction on the back of the heater substrate 11*a;*

(8) first and second conductive patterns 11*i* and 11*j*, respectively, formed on the back of the heater substrate 11*a* so as to be electrically connected to the temperature detector 14;

(9) conductive through holes 11*k* and 11*l* for electrically connecting respective end portions of the first and second conductive patterns 11*i* and 11*j* to the first and second electrode patterns 11*g* and 11*h* for output to the temperature control unit, respectively, on the surface of the heater substrate 11*a*; and the like.

The heater 11 is fixed and held by being fitted within a heater fitting groove formed at a central portion on the lower surface of the stay holder 12 along the longitudinal direction of the stay holder 12, by making the surface (a surface facing the heater substrate 11*a* where the electrically-heat-generating resistive layer 11*b* and the glass protective layer 11*c* are formed) of the heater 11 a surface in sliding contact with the fixing film 13, in a state in which the surface of the heater 11 is exposed outward.

Figure 5:
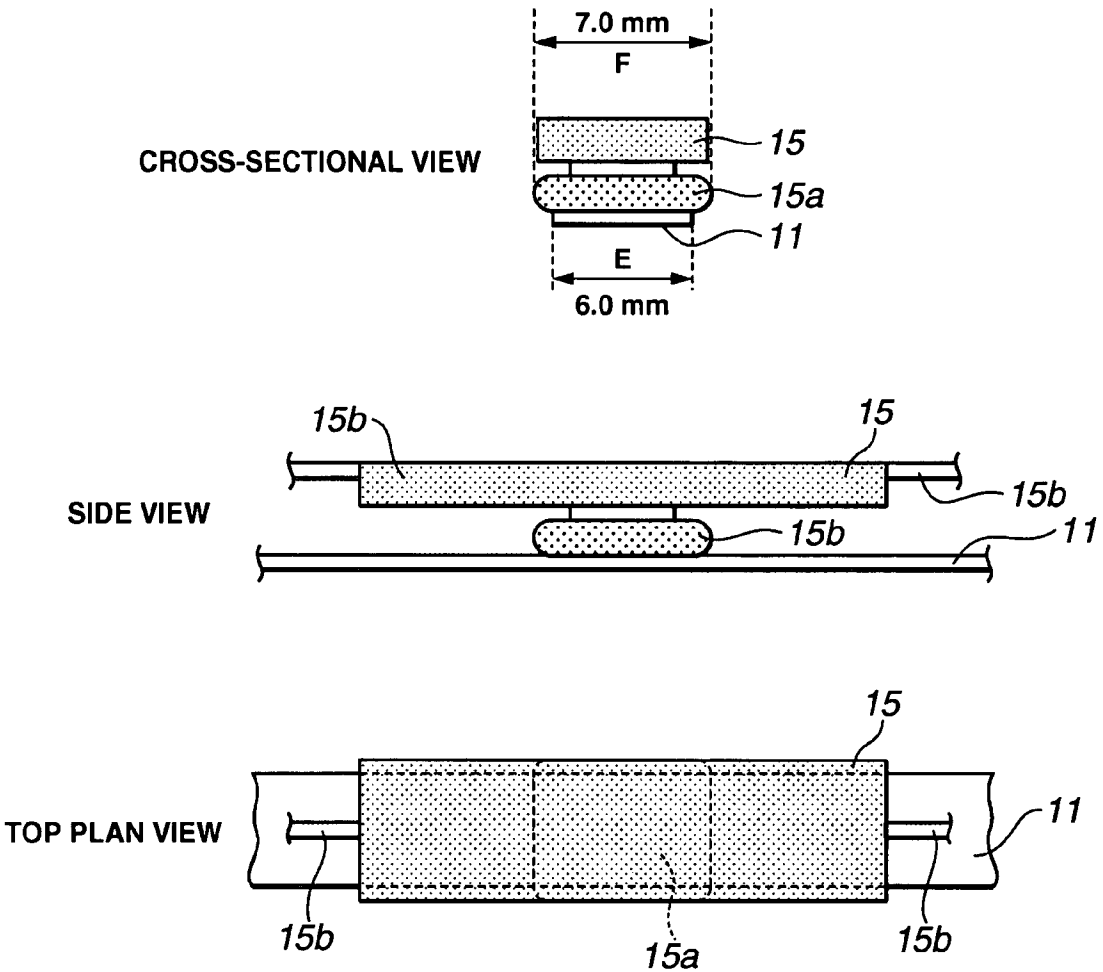
FIG. 5 is a diagram illustrating the configuration of a thermoprotector (thermoswitch)

Reference numeral 15 represents a thermoprotector, such as a temperature fuse, a thermoswitch, or the like. FIG. 5 is a schematic diagram illustrating the thermoprotector (thermoswitch) 15. In FIG. 5, reference numeral 15*a* represents a heat collecting plate (heat collecting portion) provided in a state of protruding from the main body of the thermoprotector 15. Reference numeral 15*b*, 15*b* are lead wires of the main body of the thermoprotector 15. The thermoprotector 15 is held on a safety-element holder (not shown). The safety-element holder is mounted on the stay holder 12 holding the heater 11 so that the heat collecting plate 15*a* of the thermoprotector 15 contacts a predetermined designed position on the back of the heater 11. In order to prevent unevenness in heat collection by the heat collecting plate 15*a*, a heat conductive grease is coated on the contact surface between the heat collecting plate 15*a* and the heater 11. As shown in FIG. 4, the lead wires 15*b*, 15*b* of the main body of the thermoprotector are connected in series to a current supply circuit for the heater 11.

A current feeding connector 101 is fitted at the first and second current supplying electrode patterns 11*d* and 11*e* of the heater 11 fixed and held on the stay holder 12, and electric contacts at the current feeding connector 101 are brought in contact with the current supplying electrode patterns 11*d* and 11*e*.

A connector 102 for temperature control is fitted at the first and second electrode patterns 11*g* and 11*h* for output to the temperature control unit fixed and held on the stay holder 12, and electric contacts at the connector 102 for temperature control are brought in contact with the electrode patterns 11*g* and 11*h* for output to the temperature control unit.

There are also shown an AC power supply 103, a control circuit unit (CPU (central processing unit)) 104, and a Triac 105. The temperature of the heater 11 is abruptly raised by heat generation of the electrically-heat-generating resistive layer 11*b* over the entire length by supplying current from the AC power supply 103 to the electrically-heat-generating resistive layer 11*b* via the current feeding connector 101 and the first and second current supplying electrode patterns 11*d* and 11*e*. The temperature rise of the heater 11 is detected by the temperature detector 14, and electrical information relating to the detected temperature is input to the control circuit unit 104 via the first and second conductive patterns 11*i* and 11*j*, the conductive through holes 11*k* and 11*l*, the first and second electrode patterns 11*g* and 11*h* for output to the temperature control unit, and the connector 102 for temperature control. The control circuit unit 104 controls the phase, the wave number, and the like of electric power to be supplied to the electrically heat generating resistive layer 11*b* of the heater 11 from the AC power supply 103 by controlling the Triac 105 based on information relating to the detected temperature, to maintain the temperature of the heater 11 to a predetermined fixing temperature.

The thermoprotector 15 disposed so that the heat collecting plate 15*a* contacts the back of the heater 11 is inserted so as to be electrically series to the current supply circuit for the electrically-heat-generating resistive layer 11*b*. If current supply from the AC power supply 103 to the electrically-heat-generating resistive layer 11*b* becomes in an uncontrolled state due to some failure in the control circuit 104, the Triac 105, or the like, such that current becomes continuously supplied to the electrically-heat-generating resistive layer 11*b*, and the temperature of the heater 11 has a value higher than an allowable value, the thermoprotector 15 forcedly shuts down current supply to the electrically-heat-generating resistive layer 11*b* to secure safety.

In FIG. 4, W represents the length of the electrically-heat-generating resistive layer 11*b*. The value W is set to a value more or less smaller than the length D of the elastic layer 22 of the pressing roller 20 contacting the heater 11 via the fixing film 13, in order to prevent a local temperature rise in the electrically-heat-generating resistive layer 11*b* because a part thereof is outside of the pressing roller 20, and destruction of the electrically-heat-generating resistive layer 11*b* due to thermal stress.

Symbol S represents a reference of conveyance of the recording material. The apparatus of the first embodiment is an apparatus having a reference at the center in the longitudinal direction of a region of conveyance of the recording material in the main body of the apparatus. Symbol A represents the width of the region of conveyance of the recording material for a sheet of a maximum-width size that can be fed in the apparatus (the width of a recording-material maximum conveyance region), and symbol B represents the width of a region of conveyance of the recording material for a sheet of a minimum-width size that can be fed in the apparatus (the width of a recording-material minimum conveyance region).

The width W of the electrically-heat-generating resistive layer 11*b* is set to a value sufficiently larger than the width A of the recording-material maximum conveyance region. It is thereby possible to prevent influence of sag in the temperature at end portions (due to leakage of heat from end portions of the heater 11 to current supplying electrical contacts, connectors, and the like), so that an excellent fixing property can be obtained over the entire surface of the recording material P. In some cases, the fixing property at end portions is improved by increasing the amount of heat generation at the end portions by decreasing the width of the electrically-heat-generating resistive layer 11*b* at end portions of a sheet feeding region.

the temperature detector 14 and the thermoprotector 15 are disposed within the width B of the recording-material minimum conveyance region on the back of the heater 11. In order to heat and fix the toner image t on the recording material P at an appropriate fixing temperature without causing problems of a failure in fixing, a high-temperature offset, and the like even if the recording material P having the minimum width that can be conveyed in the main body of the image forming apparatus is conveyed, the temperature detector 14 is provided within the width B of the minimum recording-material conveyance region.

The temperature tends to rise in a non-conveyance region in the longitudinal direction of the heater 11 where the recording material is not fed, because heat is not transferred to the recording material. Accordingly, if the thermoprotector 15 is disposed in this recording-material non-conveyance region, there is the possibility that an erroneous operation in which current supply to the heater 11 is shut down even if the heater 11 does not run away. Hence, in order to prevent an erroneous operation of the thermoprotector 15, the thermoprotector 15 is provided within the width B of the recording-material minimum conveyance region.

The thermoprotector 15 has a relatively large heat capacity. Accordingly, by contact of the thermoprotector 15 to the back of the heater 11, the heat quantity generated in the electrically-heat-generating resistive layer 11*b* is transferred to the thermoprotector 15, resulting in supply of insufficient heat quantity to the recording material P, whereby a failure in fixing may sometimes occur at a portion of the heater 11 corresponding to the contact position with the thermoprotector 15. In order to prevent such a problem, the resistance value per unit length of the electrically-heat-generating resistive layer 11*b* at the contact position with the thermoprotector 15 is made larger than the resistance value at other portions by more or less reducing the width of a portion "a" of the electrically-heat-generating resistive layer 11*b* shown in FIG. 4, to recover the heat quantity transferred to the thermoprotector 15. As a result, the amount of heat supply from the heater 11 to the recording material P is made constant over the longitudinal direction of the heater 11, and excellent heating fixing not having unevenness in fixing is realized.

As in the case of the thermoprotector 15, since the temperature detector 14 contacts the back of the heater 11, there is the possibility that heat generated by the electrically-heat-generating resistive layer 11*b* is transferred to the temperature detector 14. However, by using a temperature detector 14 having a small heat capacity, such as a chip thermistor, or the like, the heat quantity transferred from the heater 11 can be minimized. Accordingly, uniform fixing can be realized without degrading uniformity in fixing in the recording material in the longitudinal direction even if a countermeasure similar to the above-described countermeasure of implementing insufficient heating due to the provision of the thermoprotector 15 is not performed.

(3) Countermeasures for Problems Due to Variations in the Contact Position of the Safety Element In the above-described heating fixing apparatus, there is the problem that a high-temperature offset, a failure in fixing, unevenness in gloss, and the like occur at the position of contact of the heater 11 with the thermoprotector (safety element) 15 even if the resistance value is adjusted in order to supplement insufficient heating due to the provision of the thermoprotector 15.

A high-temperature offset, a failure in fixing, and unevenness in gloss at the contact position of the heater 11 with the thermoprotector 15 occur because:

(1) the resistance value of a high-resistance region (region "a" shown in FIG. 4) of the electrically-heat-generating resistive layer 11*b* provided in order to compensate for heat transferred to the thermoprotector 15 varies among manufactured heaters;

(2) the amount of coating of the heat conductive grease coated on the contact surface between the heat collecting plate 15*a* of the thermoprotector 15 and the heater 11 varies; and (3) the relative position between the thermoprotector 15 and the heater 11 in the recording-material conveying direction deviates from a designed position.

First, in order to mitigate variations in the amount of heat generation of the portion "a" of the electrically-heat-generating resistive layer 11*b*, the amount of heat generation is increased by narrowing the width of the portion "a" of the electrically-heat-generating resistive layer 11*b* than the width of other portions for compensating for transfer of heat to the thermoprotector 15, as described above. However, since the electrically-heat-generating resistive layer 11*b* is formed according to screen printing, variations in manufacture inevitably occur, resulting in variations in the amount of heat generation at the portion "a" of the electrically-heat-generating resistive layer 11*b*, thereby causing a high-temperature offset, a failure in fixing, and unevenness in gloss. Accordingly, the width of the portion "a" is controlled to a degree of not generating a failure in the obtained image (equal to or less than 10% in variations in the resistance value).

Variations in the amount of coating of the heat-conductive grease also cause a high-temperature offset, a failure in fixing, and unevenness in gloss because heat transfer from the heater 11 to the thermoprotector 15 differs depending on the amount of coating. The amount of coating is controlled in the order of mg in order to prevent occurrence of a failure in an image.

A factor larger than the above-described factors (1) and (2) is the factor (3) of variations in the relative position between the thermoprotector 15 and the heater 11 in the recording-material conveying direction. Since the safety element is mounted on the heater using many components, such as a heater holder, a safety-element holder, and the like, accuracy in mounting of the safety element results from addition of dimensional tolerances of respective components. Accordingly, the contact position of the safety element with the heater tends to vary with respect to a designed position. It has become clear that the temperature distribution in the sheet conveying direction at the contact position of the safety element with the heater differs from the temperature distribution at other portions, and a high-temperature offset, a failure in fixing, and unevenness in gloss occur at the contact position of the safety element with the heater.

Figure 7A:
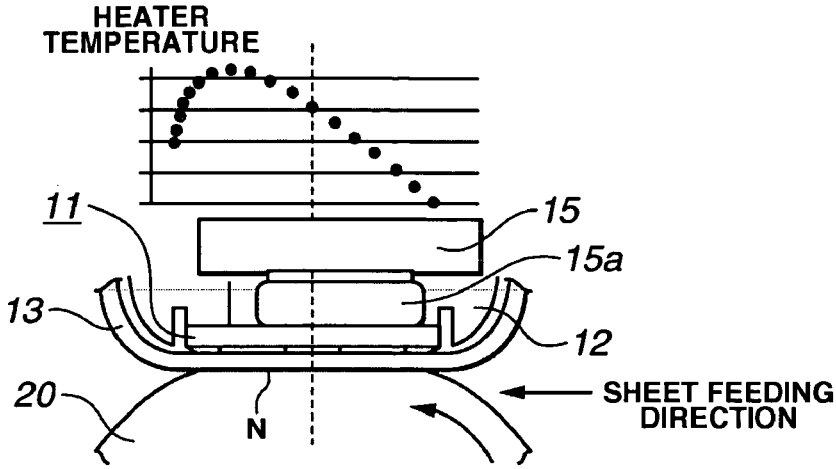
FIGS. 7A–7C are graphs illustrating temperature distributions in a conventional heater.
Figure 7B:
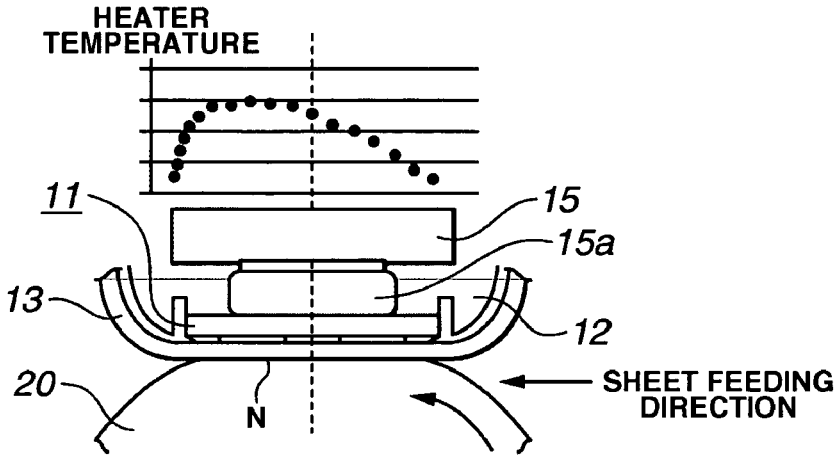
Figure 7C:
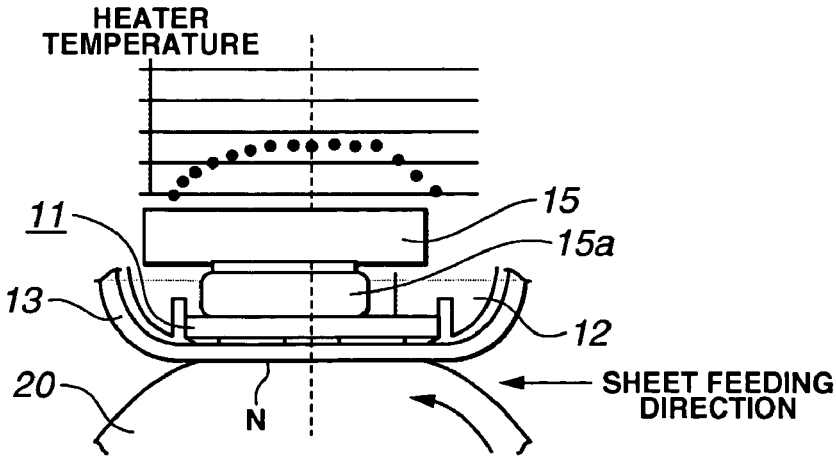

FIGS. 7A–7C illustrate temperature distributions in the shorter direction (the sheet feeding direction) of the heater when the relative position between the thermoprotector 15 and the heater 11 varies with respect to a designed position in a conventional apparatus. In the conventional apparatus, the size of the heat collecting plate 15*a* of the thermoprotector 15 in the recording-material feeding direction is smaller than the width of the heater 11 in the recording-material feeding direction. Usually, in the temperature distribution in the heater 11 in the sheet feeding direction (the direction of the width of the heater) during sheet feeding, the temperature is relatively low at the upstream side and increases toward the downstream side because heat moves toward the downstream side due to the rotation of the pressing roller 20 and the movement of the recording material P. As shown in FIG. 7A, when the thermoprotector 15 deviates in the direction of the width of the heater toward the upstream side in the sheet feeding direction where the heater temperature is relatively low, from a designed position shown in FIG. 7B (in this case, a position where the center of the heat collecting plate 15*a* in the direction of the width of the heater 11 is made to coincide with the center of the heater 11 in the direction of the width), heat transfer to the thermoprotector 15 decreases, and heat transfer to the recording material P increases. As a result, a high-temperature offset tends to occur. As shown in FIG. 7C, when the thermoprotector 15 deviates in the direction of the width of the heater 11 from the designed position shown in FIG. 7B toward the downstream side where the heater temperature is high, heat transfer to the thermoprotector 15 increases, and heat transfer to the recording material P decreases. Hence, a failure in fixing tends to occur.

That is, when the width of the heat collecting plate 15*a* of the thermoprotector 15 is smaller than the width of the heater 11, if the contact position of the thermoprotector 15 with the heater 11 deviates in the sheet feeding direction, the temperature distribution of a portion of the heater 11 at a position corresponding to the contact position with the thermoprotector 15 in a direction orthogonal to the sheet feeding direction (the longitudinal direction of the heater 11) differs from the temperature distribution in other portions in the longitudinal direction of the heater 11. When the contact position of the thermoprotector 15 deviates to the upstream side in the sheet feeding direction, since the heat quantity transferred from the heater 11 increases at the upstream side and decreases at the downstream side, the temperature distribution in the heater 11 is as shown in FIG. 7A. At that time, since the thermoprotector 15 contacts the heater 11 at a portion where the heater temperature is low in the shorter direction of the heater 11, the amount of heat transfer to the thermoprotector 15 decreases as compared with a case in which the thermoprotector 15 contacts the heater 11 at the designed position shown in FIG. 7B, and the amount of heat transfer to the recording material P increases. When the contact position of the thermoprotector 15 deviates to the downstream side in the sheet feeding direction, since the heat quantity transferred from the heater 11 decreases at the upstream side and increases at the downstream side, the temperature distribution in the heater 11 is as shown in FIG. 7C. At that time, since the thermoprotector 15 contacts the heater 11 at a portion where the heater temperature is high in the shorter direction of the heater 11, the amount of heat transfer to the thermoprotector 15 increases as compared with a case in which the thermoprotector 15 contacts the heater 11 at the designed position, and the amount of heat transfer to the recording material P decreases.

That is, since the width of the heat collecting plate 15*a* of the thermoprotector 15 is smaller than the width of the heater 11 in the sheet feeding direction, if the relative position between the heater 11 and the thermoprotector 15 in the sheet feeding direction differs, the heat quantity transferred from the heater 11 to the thermoprotector 15 differs. As a result, the relationship between the quantity of heat generation of the high resistance region (region "a" shown in FIG. 4) for implementing the heat quantity transferred to the thermoprotector 15 and the heat quantity transferred to the thermoprotector 15 deviates from a designed relationship, and the temperature distribution in the heater 11 in the longitudinal direction deviates from the designed temperature distribution.

On the other hand, in the first embodiment, the size of the heat collecting plate 15*a* of the thermoprotector 15 in the recording-sheet feeding direction (the width of the heat collecting plate 15*a*) is made larger than the size of the heater 11 in the recording-material feeding direction (the width of the heater 11).

More specifically, in the first embodiment, as shown in FIG. 5, the size F of the heat collecting plate 15*a* of the thermoprotector 15 in the recording-material feeding direction (the width of the heat collecting plate 15*a*) is set to 7.0 mm that is larger than a width E of the substrate of the heater 11 (the width of the heater 11) of 6.0 mm.

Figure 6A:
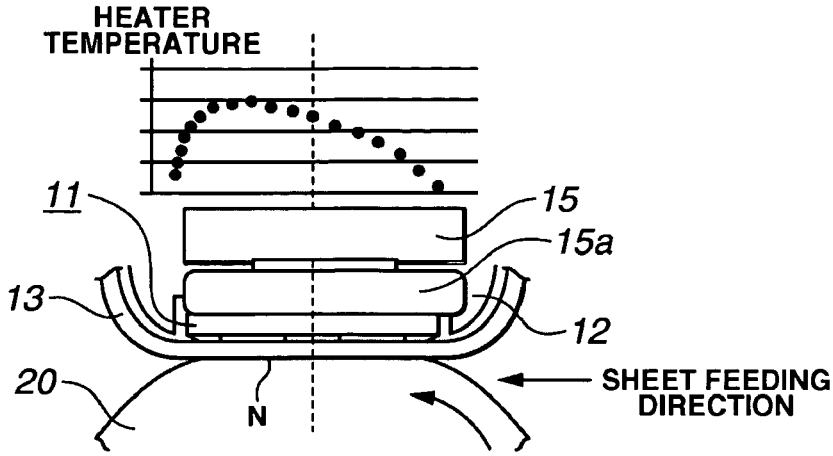
FIGS. 6A–6C are graphs illustrating temperature distributions in the heater in the first embodiment.
Figure 6B:
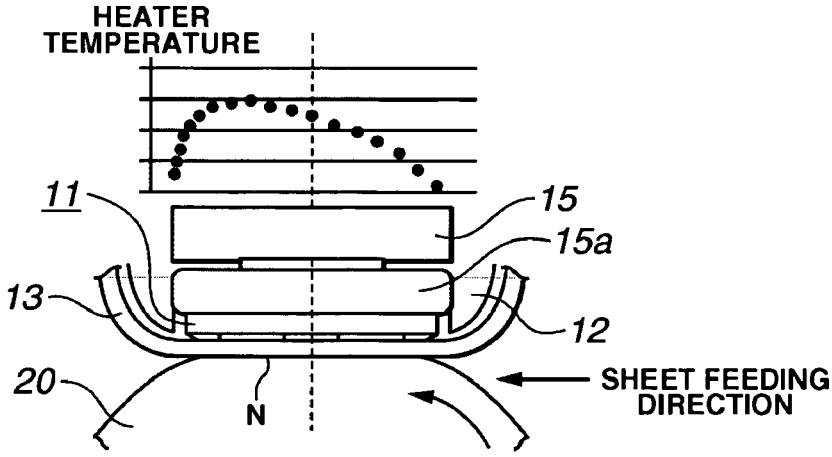

It can be understood that, when the width F of the heat collecting plate 15*a* of the thermoprotector 15 is larger than the width E of the heater 11 as in the first embodiment, there is little change in the temperature distribution in the heater 11 even if the contact position of the thermoprotector 15 with the heater 11 in the sheet feeding direction deviates with respect to the designed position shown in FIG. 6B, as shown in FIGS. 6A and 6B. That is, since the width of the heat collecting plate 15*a* in the sheet feeding direction is larger than the width of the heater 11 in the sheet feeding direction, the heat quantity transferred from the heater 11 to the thermoprotector 15 little changes even if the relative position between the heater 11 and the thermoprotector 15 more or less deviates. Accordingly, the relationship between the quantity of heat generation of the high-resistance region (region "a" shown in FIG. 4) for implementing the heat quantity transferred to the thermoprotector 15 and the heat quantity transferred to the thermoprotector 15 is a designed relationship, and the temperature distribution in the heater 11 in the longitudinal direction is a designed temperature distribution.

Figure 6C:
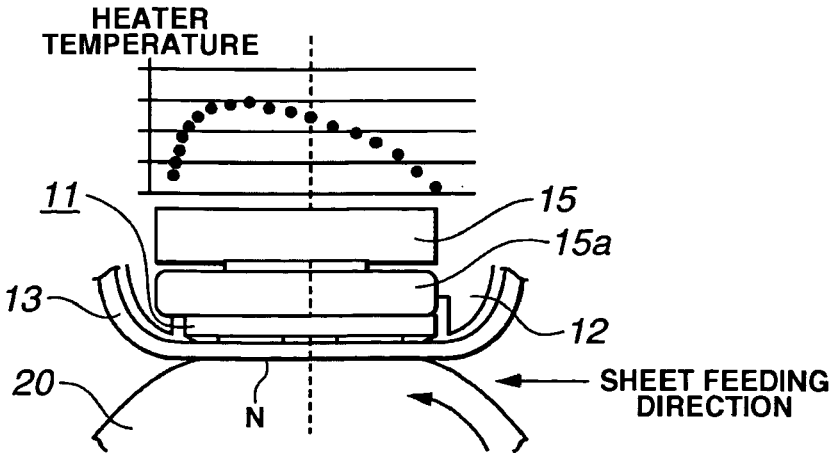

Results of check of generation of a high-temperature offset and a failure in fixing when the contact position of the thermoprotector 15 deviates in the conventional case shown in FIGS. 7A–7C, and in the first embodiment shown in FIGS. 6A–6C are shown in Tables 1 and 2, respectively.

TABLE 1

Relationship between the contact position of the thermoswitch and a high-temperature offset

| | Deviation to the downstream side | Designed position | Deviation to the upstream side |
|---|---|---|---|
| Conventional Case | A | A | B |
| First Embodiment | A | A | A |

A: Does not occur
B: Slightly occurs
C: Occurs

TABLE 2

Relationship between the contact position of the thermoswitch and a failure in fixing

| | Deviation to the downstream side | Designed position | Deviation to the upstream side |
|---|---|---|---|
| Conventional Case | B | A | A |
| First Embodiment | A | A | A |

A: Does not occur
B: Slightly occurs
C: Occurs

It can be understood from Table 1 that, while in the conventional configuration, when the thermoprotector 15 deviates to the upstream side in the sheet feeding direction, a high-temperature offset occurs at the position where the thermoprotector 15 is provided in the longitudinal direction of the heater 11, a high temperature offset does not occur in the first embodiment. It can also be understood from Table 2 that, while in the conventional configuration, when the thermoprotector 15 deviates to the downstream side in the sheet feeding direction, a failure in fixing occurs at the position where the thermoprotector 15 is provided in the longitudinal direction of the heater 11, a failure in fixing does not occur in the first embodiment.

Although in the first embodiment, the width F of the heat collecting plate 15*a* of the thermprotector 15 is set to 7.0 mm, and the width E of the heater 11 is set to 6.0 mm, it is preferable from the viewpoint of tolerance in mounting of the thermoprotector 15 that the width F of the heat collecting plate 15*a* of the thermoprotector 15 is larger than the width E of the heater 11 by about 0.5–4.0 mm.

As described above, by making the width of the heat collecting plate 15*a* of the thermoprotector 15 larger than the width of the heater 11, variations in the temperature distribution in the thermoprotector 15 in the sheet feeding direction due to deviation in the contact position of the thermoprotector 15 with the heater 11 (in the sheet feeding direction) become small even if the contact position of the thermoprotector 15 with the heater 11 varies within a tolerance in mounting. Accordingly, it is possible to prevent generation of a high-temperature offset and a failure in fixing without strictly controlling the contact position of the thermoprotector 15, and to obtain an excellent image not having a high-temperature offset and a failure in fixing.

(Second Embodiment)

Figure 8:
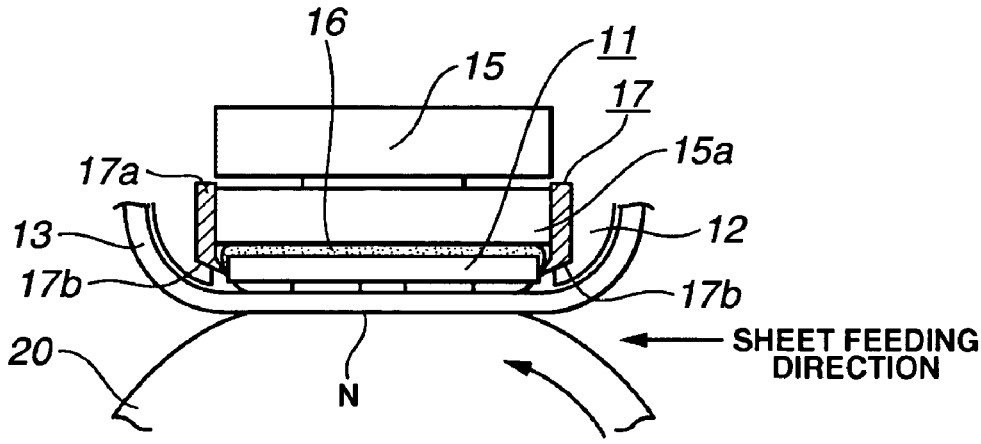
FIG. 8 is a schematic cross-sectional view of a principal portion in a second embodiment of the present invention.

In a second embodiment of the present invention, a configuration will be described in which, as shown in FIG. 8, a grease obtained by dispersing a heat conductive filler is used as the heat conductive filler 16 provided at the contact surface between the heat collecting plate 15*a* of the thermoprotector 15 and the heater 11 for improving the response property of the thermoprotector 15 and stabilization, and a heat-conductive-grease extrusion preventing member (grease extrusion regulating member) for preventing (suppressing) extrusion of the heat-conductive grease 16 to the surface side, i.e., a sliding surface with the fixing film, of the heater 11. Since other conditions are the same as in the first embodiment, further description thereof will be omitted.

As in the first embodiment, when the size F of the heat collecting plate 15*a* of the thermoprotector 15 is made larger than the width E of the heater 11, the heat-conductive grease 16 provided at the contact surface between the heat collecting plate 15*a* of the thermoprotector 15 and the heater 11 tends to be extruded to the surface side, i.e., a sliding surface with the fixing film 13, of the heater 11. No problem will arise if the heat-conductive grease 16 does not hinder the sliding property between the surface of the heater 11 and the fixing film 13. However, when a heat-conductive filler, such as alumuna, AlN, or the like, is dispersed in order to improve heat conduction, since the heat-conductive filler, such as alumina, AlN, or the like, is very hard, extrusion of the heat conductive filler to the sliding surface of the heater 11 with the fixing film 13 hinders the sliding property of the fixing film 13, sometimes resulting in an increase in the sliding torque of the fixing film 13, or damage of the inner surface of the fixing film 13 or the surface of the heater 11.

In the second embodiment, as shown in FIG. 8, a member 17 for preventing (or suppressing) extrusion of the heat-conductive grease 16 provided at the contact surface between the heat collecting plate 15*a* of the thermoprotector 15 and the heater 11 to the surface side, i.e., a sliding surface of the heater 11 with the fixing film, is provided.

Figure 9:
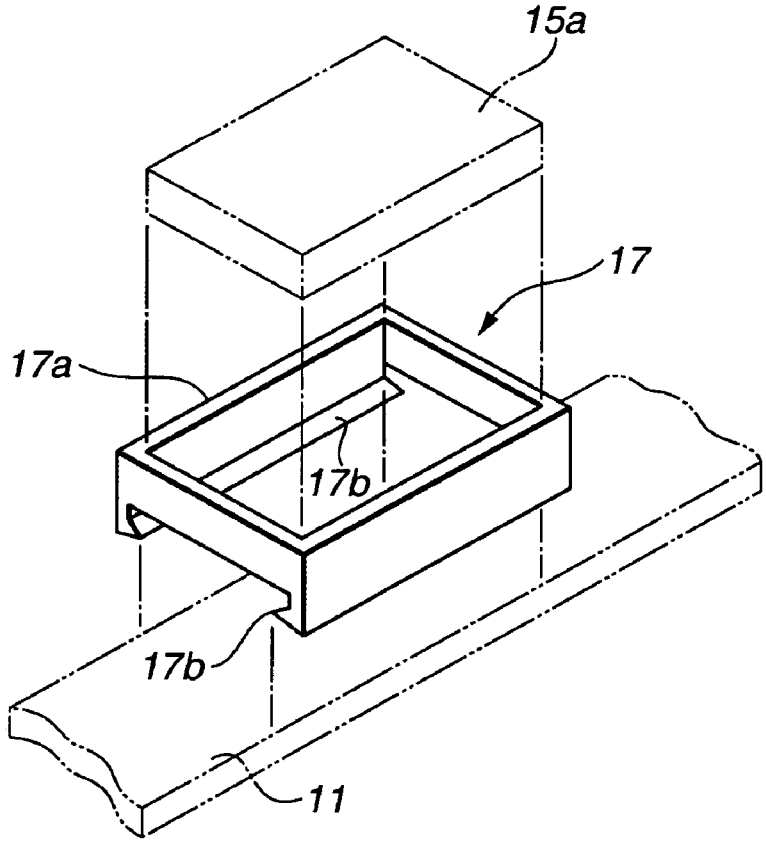
FIG. 9 is a perspective view illustrating a member for preventing extrusion of a heat-conductive grease.

FIG. 9 is a perspective view illustrating the heat-conductive-grease extrusion preventing member 17 according to the second embodiment. This heat-conductive-grease extrusion preventing member 17 is a formed member of a heat-resistant and oil-resistant elastic rubber, and includes a frame-shaped shield portion 17*a* tightly fitted to the outer circumference of the heat collecting plate 15*a* of the thermoprotector 15, and shied portions 17*b* whose cross section has the shape of a wedge provided so as to protrude inwardly along the lower edges of the front frame side and the rear frame side (upstream and downstream frame sides in the recording-material feeding direction at the fixing nip portion) of the frame-shaped shield portion 17*a*.

The grease extrusion preventing member 17 of the second embodiment is mounted in the following order. First, the frame-shaped shield portion 17*a* of the heat-conductive-grease extrusion preventing member 17 is tightly fixed to the outer circumference of the heat collecting plate 15*a* of the thermoprotector 15. A heat-conductive grease is coated in advance on the heat collecting plate 15*a*. Then, the shield portions 17*b* whose cross section has the shape of a wedge is fitted to the upstream and downstream side walls of the heater 11 in the recording-material feeding direction by outwardly bending the shied portions 17*b* against elasticity. By thus contacting the heat collecting plate 15*a* of the thermoprotector 15 to the back of the heater 11 via the heat-conductive grease 16, the thermoprotector 15 is disposed on the heater 11.

The heat-conductive grease 16 provided between the heat collecting plate 15*a* of the thermoprotector 15 and the back of the heater 11 is held in a sealed state by the frame-shaped shield portion 17*a* of the heat-conductive-grease extrusion preventing member 17 and the shield portions 17*b* whose cross section has the shape of a wedge provided so as to protrude inwardly along the lower edges of the front and rear frame sides, so that extrusion of the heat-conductive grease 16 to the surface side, i.e., the sliding surface with the fixing film is prevented.

Table 3 illustrates the torque of the fixing apparatus when the heat-conductive-grease extrusion preventing member 17 is present and absent, and durability of the fixing film 13.

TABLE 3

The torque of the fixing apparatus when the heat-conductive-grease preventing member 17 is present and absent

| Number of fed sheets | When the member 17 is absent | When the member 17 is present |
|---|---|---|
| Initial | 2.0 kg · cm | 2.0 kg · cm |
| 20,000 | 2.4 kg · cm | 2.0 kg · cm |
| 50,000 | 2.6 kg · cm | 2.2 kg · cm |
| 70,000 | 3.0 kg · cm | 2.2 kg · cm |

TABLE 4

The life of the fixing apparatus when the heat-conductive-grease preventing member 17 is present and absent

| Number of fed sheets | When the member 17 is absent | When the member 17 is present |
|---|---|---|
| Initial | A | A |
| 25,000 | B | A |
| 50,000 | B | A |
| 75,000 | C | B |

C: Film broken
B: Damage of the inner surface of the film occurs
A: No problem

It can be understood from Table 3 that while, when the grease extrusion preventing member 17 is absent, the torque of the fixing apparatus, i.e., the sliding torque of the fixing film, increases as the number of fed sheets increases, when the grease extrusion preventing member 17 is present, the torque of the fixing apparatus hardly increases even if the number of fed sheets increases and exceeds 50,000 that is the nominal life of the fixing apparatus.

It can also be understood from Table 4 that while, when the grease extrusion preventing member 17 is absent, rubbed damage occurs near the contact position of the inner surface of the fixing film 13 with the thermoswitch 15 as the number of fed sheets increases, and the fixing film is broken at a number of fed sheets of 75,000, when the grease extrusion preventing member 17 is present, the fixing film 13 is hardly damaged.

When the grease extrusion preventing member 17 is absent, a slip jam of a sheet due to an increase of the sliding resistance of the fixing film 13 starts to occur when the number of fed sheets is about 50,000.

Although in the second embodiment, a configuration in which the grease extrusion preventing member 17 is mounted on the thermoprotector 15, the same effects may also be obtained according to any other appropriate method, such as a method in which the member 17 is formed as one body with the stay holder 12.

Although in the second embodiment, the case of a grease in which a heat-conductive filler is dispersed has been illustrated, the same effects may, of course, also be obtained in any other case, such as a case in which a grease hindering sliding between the heater 11 and the fixing film 13 is used.

As described above, by adopting a configuration in which, when the heat-conductive grease 16 is provided at the contact surface between the thermoprotector 15 and the heater 11, the heat-conductive grease 16 is not extruded to the sliding surface of the heater 11 with the fixing film 13, it is possible to mitigate an increase of the torque of the fixing apparatus and damage to the fixing apparatus, particularly, the fixing film 13, even if the width of the heat collecting plate 15*a* of the thermoprotector 15 is made larger than the width of the heater 11.

(Other Configurations)

1) The heating apparatus of the present invention is not necessarily used as the image heating fixing apparatus of the foregoing embodiments, but is also effective as an image heating apparatus, such as a temporary fixing apparatus for temporarily fixing an unfixed image on a recording material, a surface ameliorating apparatus for ameliorating the surface property of an image, such as gloss, or the like, by again heating a recording material bearing an unfixed image, or the like.

2) Although in the foregoing embodiments, a ceramic heater having the configuration shown in FIG. 4 is used as the heater 11, a ceramic heater having a different structure may, of course, also be used. For example, a so-called back-heating-type ceramic heater in which the electrically-heat-generating resistive layer 11*b* is provided on a surface of the heater substrate 11*a* opposite to the sliding surface of the flexible member may be used.

3) Although in the foregoing embodiments, a contact-type thermistor is used as temperature detection means for the heater, for example, a non-contact-type temperature detection means for detecting a temperature using radiation, or the like may also be used without causing any problem. Furthermore, temperature control can also be performed by disposing the temperature detection means at a location different from the location shown in the foregoing embodiments.

4) The flexible member is not limited to a heat-resistant resin film. A metal film or a composite film may also be used.

5) Although in the foregoing embodiments, the flexible member is a cylindrical member (a flexible sleeve) that is driven by the pressing roller, any other appropriate rotation means may also be used. For example, a configuration may be adopted in which a driving roller is provided within an endless film, and a film is rotated by rotatably driving the driving roller.

6) A configuration may also be adopted in which the flexible member has the shape of a rolled long web having an end that is moved by being forwarded via the heater.

7) The pressing member is not limited to a roller, but may also have the shape of a rotating endless belt.

The individual components shown in outline or designated by blocks in the drawings are all well known in the image heating apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image heating apparatus comprising:

a heater for heating an image formed on a recording material, said heater including a substrate and a heat generating resistor formed on said substrate; and a thermoprotector for suppressing an excessive temperature rise of said heater, said thermoprotector comprising a heat collecting portion contacting said heater, wherein a width of said heat collecting portion in a moving direction of the recording material is larger than a width of said substrate in the moving direction of the recording material.

2. An image heating apparatus according to claim 1, wherein the width of said heat collecting portion in the moving direction of the recording material is larger than the width of said substrate in the moving direction of the recording material by 0.5–4.0 mm.

3. An image heating apparatus according to claim 1, wherein a resistance value per unit length of said heat generating resistor in a region where said heat collecting portion contacts said heater in a longitudinal direction of said heater is larger than a resistance value per unit length of other regions.

4. An image heating apparatus according to claim 1, wherein a heat-conductive grease is coated between said heater and said heat collecting portion, and wherein said apparatus further comprises a grease-extrusion regulating member for suppressing extrusion of said grease from a portion between said heater and said heat collecting portion.

5. An image heating apparatus according to claim 1, further comprising a flexible sleeve rotating while contacting said heater, and a pressing roller forming a heating nip portion with said heater via said sleeve.

* * * * *